United States Patent [19]

Raff

[11] Patent Number: 4,673,460

[45] Date of Patent: Jun. 16, 1987

[54] DERESINATION METHOD OF WOOD PULP

[75] Inventor: Donald K. Raff, Duluth, Ga.

[73] Assignee: Stepan Company, Northfield, Ill.

[21] Appl. No.: 654,865

[22] Filed: Sep. 27, 1984

[51] Int. Cl.[4] ..... D21C 3/20

[52] U.S. Cl. ..... 162/75; 162/76; 162/77; 162/DIG. 4

[58] Field of Search ..... 162/72, 75, 76, 77, 162/DIG. 3, DIG. 4

[56] References Cited

U.S. PATENT DOCUMENTS

| | | | |
|---|---|---|---|
| 2,144,756 | 1/1939 | Fritz | 162/48 |
| 2,716,058 | 8/1955 | Rapson et al. | 162/72 |
| 2,999,045 | 9/1961 | Mitchell et al. | 162/77 |
| 3,446,700 | 5/1969 | Hall | 162/72 |
| 3,619,351 | 11/1971 | Kolosh | 162/76 |
| 4,010,067 | 3/1977 | Hoeger et al. | 162/76 |
| 4,094,735 | 6/1978 | Holgersson | 162/76 |
| 4,184,912 | 1/1980 | Payton | 162/76 |
| 4,311,552 | 1/1982 | Brucato et al. | 162/75 |
| 4,426,254 | 1/1984 | Wood et al. | 162/72 |
| 4,444,621 | 4/1984 | Lindahl | 162/26 |

FOREIGN PATENT DOCUMENTS

| | | | |
|---|---|---|---|
| 0670654 | 6/1979 | U.S.S.R. | 162/DIG. 4 |

*Primary Examiner*—S. Leon Bashore
*Assistant Examiner*—Andrew J. Anderson
*Attorney, Agent, or Firm*—Bell, Seltzer, Park & Gibson

[57] ABSTRACT

An improved method for deresination of wood chips or pulp is provided. The method comprises contacting the chips or pulp with an ethoxylated alkyl phenol deresinating composition during processing to reduce the level of natural resins present therein. The improvement comprises substituting a sufonated fatty acid for part of the ethoxylated alkyl phenol while maintaining substantially the same level of deresination.

17 Claims, No Drawings

DERESINATION METHOD OF WOOD PULP

BACKGROUND OF THE INVENTION

This invention relates to a method for significantly reducing the levels of natural resins which are present in wood. The method described herein is characterized by the significant economic benefits it provides, without compromising the quality of the wood pulp produced.

When harvested, trees contain varying concentrations of compounds known in the art generically as resins. These compounds include fatty acids, rosin acids, sterols, hydrocarbons and fat. Although present in relatively small quantities, these resins create significant processing difficulties in manufacturing products from processed wood pulp. The problems are particularly acute in the case of hardwood derived alpha cellulose which is used in manufacturing viscose rayon, cellophane, plastics, and nitrocellulose. Resins are present in lower overall concentrations (on the order of 0.1 to 2%) in most species of hardwoods than are found in softwoods, but their reduction to acceptable levels for processing is more difficult.

Methods have been described previously for reducing the levels of resin in wood during processing. The emphasis on chemical methods of deresination has been placed on certain nonionic surfactants, such as certain condensation products of ethylene oxide. For example, U.S. Pat. No. 2,716,058 describes a class of deresination agents which includes ethoxylated organic substances including phenols and natural products such as tall oil. According to the patent, these agents are preferably used in the caustic extraction stage of the bleaching process. Other chemical agents are described, for example in U.S. Pat. Nos. 2,999,045 (copolymers of polyethylene oxide and polypropylene oxide) and 3,446,700 (condensation products of vicinal epoxide and phenol). U.S. Pat. No. 2,144,756 describes a two-step process for removing "pitch" including the addition of an organic solvent, such as kerosene, to dissolve the pitch and thereafter adding an emulsifier, of which sulfonated fatty acids are one suggested class, to aid in removing the pitch in a subsequent stage of processing.

The chemical effectiveness of existing deresination methods is not the sole consideration for a manufacturer of wood pulps, and particularly producers of alpha cellulose. Instead, the degree of desired deresination must be balanced against the cost of the methods utilized, and particularly the cost of the chemical deresinators. In accordance with the present invention, a deresinating composition is employed which comprises a mixture of an effective high-cost deresinator with a less expensive deresinator or extender, which composition achieves a comparable degree of deresination to that achievable with a full concentration of the more expensive deresinating agent.

Owing to the complexities of the deresinating mechanism and the mystique associated with the process, the process is not entirely understood. The deresinator may function as both a solubilizer for the resin, while at the same time serving as an emulsifier for the resin during its removal. Mixtures of deresinating agents may or may not function desirably since often one chemical in the aqueous media will alter the solvent or emulsifying properties of another. For example, U.S. Pat. No. 4,426,254 suggests that improvements in the solubility of a deresinating agent in an alkaline medium through the addition of a $C_{12}$ alpha-olefin sulfonate is desirable.

Although enhanced solubility in the medium may be desirable, enhanced solubility is by no means synonymous with enhanced effectiveness as a deresinator. Improvements of the deresinator's solubility in the water phase (cooking liquor) arguably could deleteriously affect the emulsification of the resin due to the change in the hydrophilic-hydrophobic balance (HLB) of the deresinator blend. Thus, the resin extraction functionality of the deresinator, in fact, may be reduced.

It becomes readily apparent that the availability of an economical, effective deresination process is highly desirable. Accordingly, an object of the present invention is to provide a highly effective method of deresination which enables a commercial user to reduce its costs.

SUMMARY OF THE INVENTION

It has been discovered that contrary to conventional wisdom an otherwise marginally effective deresinator may be mixed with known effective deresinators, thereby reducing the addition level of the known effective deresinator without materially compromising the overall levels of resin removal. The process may be used in any stage of the pulp manufacturing process wherein a liquid medium, and preferably an alkaline medium, is present (e.g. digesting, bleaching, etc.). The deresinating composition used in the process is a mixture of an ethoxylated alkyl phenol and a sulfonated fatty acid. The latter is only marginally effective as a deresinator when used alone, but surprisingly may be substituted for a portion of the known high performance deresinator with overall results which approximate those achieved when using a full concentration of the high performance deresinator alone. This method will therefore enable manufacturers of wood pulp who are concerned with resin removal to substitute the more economical sulfonated fatty acid for the relatively more expensive commercial deresinators without compromising the overall quality of the pulp produced. In addition, the sulfonated fatty acid preferably is derived from tall oil, a natural by-product of the Kraft process, as distinguished from ethoxylated alkyl phenols which are derived from petroleum products. As a result, a portion of the mixture used in this novel process is derived from a renewable resource.

DESCRIPTION OF THE PREFERRED EMBODIMENTS

The benefits of the present method may be realized by any wood pulp manufacturer who is concerned with the resin content of the finished product. The process is particularly applicable for manufacturers of high grade pulps (e.g. alpha cellulose) from hardwood furnish. The process may be carried out at any stage in manufacturing wood pulp where resin is ordinarily removed in a liquid medium. The deresination is accomplished preferably during digestion of the wood chips since the resin may then be separated from the fiber during brown stock washing to prevent redeposition. To this end, the temperature of the shower wash water is maintained preferably at least at 150° F. to aid the removal. Depending upon prevailing factors in a particular mill, it may be preferable to deresinate in the caustic extraction stage of the bleaching process, for example.

The composition may be admixed directly with the wood pulp, but is preferably mixed with, for example, the alkaline pulping liquor. The components of the mixture may similarly be introduced in a variety of ways, but preferably are mixed thoroughly prior to their introduction into the medium.

The composition utilized in this process is comprised of two principal components. The first component may be broadly characterized as a known effective chemical deresinator. A preferred class of deresinator is based upon ethoxylated alkyl phenols, and especially suitable are the phosphate esters of ethoxylated alkyl phenols. A particular preferred deresinator is the phosphate ester of a 9-10 mole ethoxylated nonyl phenol. This particular deresinator is sold by Westvaco Corporation under the mark Polyfac® PN-209, and is also available from other commercial sources. This deresinator is highly effective for use in manufacturing higher grades of cellulose, e.g., alpha cellulose, and finds wide commercial application for this use. Of course, known analogs of this phosphate ester which are known effective deresinators should be equally effective for purposes of practicing this deresination method. For example, variations in the number of ethylene oxide side chains should not affect measurably the operation of the mixture.

The second component in the deresinating composition is a sulfonated fatty acid. When used alone as a deresinating agent, this component is only marginally effective. In the composition of this invention, however, it functions effectively in combination with the first component. The preferred agents are derived from a mixture of tall oil fatty acids (e.g., oleic and linoleic acid) which contain 18 or more carbon atoms and at least one double bond. Such mixture also may contain a minor portion of rosin acids. Suitable tall oil fatty acids are sold commercially by Westvaco Corporation under the marks L-1, L-5, and 1483. Fatty acids derived from other sources, including soybean oil or tallow, should be equally effective. The fatty acid is preferably sulfonated with gaseous sulfur trioxide ($SO_3$) in air, but may also be sulfonated by any of several methods known to those in the art, including via the use of chlorosulfonic acid. The resulting fatty acid sulfonic acids then optionally are neutralized with any suitable base, preferably sodium hydroxide, to prepare an aqueous solution. Thereafter, the fatty acid sulfonate optionally may be hydrolyzed with a suitable base, again preferably sodium hydroxide. The most preferred fatty acid sulfonate is derived from tall oil fatty acids sulfonated with gaseous sulfur trioxide, neutralized and hydrolyzed with sodium hydroxide and is conveniently prepared as a 50% solution.

The deresinating composition is prepared from the two components for use in the process. Tests have shown that the composition produces excellent results when its preferred components are mixed at a 1:1 weight ratio. These results are explained below and set forth fully in the following examples.

EXAMPLE I

In order to evaluate the process described herein, tests were conducted utilizing various deresinators.

The wood furnish utilized was red oak and sweetgum. This wood was debarked, split and chipped. Chips for the experimental cooks passed a ¾ inch screen but were retained on a ¼ inch screen.

A vertical batch digester with an indirect liquor heating and circulating system was used for pulping. Each of the batches were pulped under the following conditions:

| | |
|---|---|
| Presteam (minutes) | 60 |
| Time Up (minutes) | 60 |
| Time At (minutes) | 75 |
| Temperature (°F.) | 338 |
| Liquor:Wood Ratio | 4:1 |
| Furnish mixture (Red Oak:Sweetgum) | 1:1 |
| O.D. weight of chips (grams) | 2,000 |

The first series of runs was performed with freshly chipped wood. The average moisture content of the Red Oak furnish was 45.21 percent and, for the Sweet Gum, 50.74 percent. The results are reported below in Table I wherein the following prefixes indicate the deresinator used:

A—Control, no deresinator added

B—Polyfac® PN-209, a phosphate ester of a 9–10 mole nonyl phenol ethoxylate

C—50 percent solution of fatty acid sulfonate (derived from tall oil, neutralized and hydrolyzed)

The reported resin contents were obtained following drying of representative samples for one hour at 103° C. The determinations were made in duplicate using TAPPI standard method T204 OS-76 using methanol as the solvent and were averaged. Owing to the low (but troublesome) resin contents of these hardwoods, the standard 10 gram sample was increased to 40 grams.

The control cook, A, indicated 0.291 percent resin in the green wood. Cook number B, which utilized only Polyfac® PN-209 as the deresinator, produced a resin content as shown of 0.158 percent. At the same level of addition, the fatty acid sulfonate alone reduced the resin content to only 0.251 percent (cook number C).

TABLE I

| Cook No. | Active Alkali Percent $Na_2O$ | Percent Sulphidity | Percent Deresinator O.D. Weight Basis | Total Yield (%) | Rejects (%) | Resin (%) |
|---|---|---|---|---|---|---|
| A | 16.6 | 25.4 | 0.0 | 41.12 | 1.63 | 0.291 |
| B | 16.6 | 27.1 | 0.73 | 42.21 | 1.04 | 0.158 |
| C | 16.6 | 26.3 | 0.73 | 40.91 | 0.75 | 0.251 |

The data of Table I show the effectiveness of the Polyfac® PN-209 as a deresinator and the marginal effectiveness of the sulfonated fatty acid when used alone.

EXAMPLE II

In a second series of cooks, the chips were air dried to maintain their quality. The moisture contents for the chips were measured at 25.66 percent for the Red Oak and 27.35 percent for the Sweet Gum. The same pulping conditions were used as set forth above in Example I.

In this series, the process disclosed herein was proven as indicated by the results set forth in Table II. The prefix "D" represents cooks using a 1:1 ratio mixture of the Polyfac® PN-209 and hydrolyzed sulfonated fatty acid. A duplicate run of cook B (Polyfac® PN-209), cook B-1, provided a resin content of 0.168 percent. Cook No. C-1, the 100% fatty acid sulfonate cook, yielded a reduction only to 0.202 percent at a concentration level of deresinator addition more than double the ordinary concentration. As the results of Cook Nos. D-1 and D-2 indicate, the process was surprisingly successful in reducing resin contents to acceptable levels despite the addition of an otherwise marginally effective deresinator to supplant an equal concentration of the Polyfac ® PN-209.

Cook No. D-2 illustrates that an alternative to realizing full cost savings from the use of the method is to increase the overall concentration level of addition for the composition and realize additional deresinating efficiency (to 0.140 percent).

Cook Nos. E-1 and E-2 were performed using a 20/80 solids blend of a 9–10 mole ethoxylated nonyl phenol and the sulfonated tall oil fatty acid. This series of tests indicates the need for routine experimental determinations by the user in order to ascertain the optimum blend ratio of the mixture in a particular setting. It is believed that the components in this mixture will yield satisfactory deresination at higher relative concentrations of the ethoxylated nonyl phenol, a known effective deresinator.

TABLE II

| Cook No. | Active Alkali Percent $Na_2O$ | Percent Sulphidity | Percent Deresinator O.D. Weight Basis | Total Yield (%) | Rejects (%) | Resin (%) |
|---|---|---|---|---|---|---|
| B-1 | 16.4 | 25.8 | 0.73 | 50.51 | 1.73 | 0.168 |
| C-1 | 16.4 | 25.8 | 1.81 | 51.01 | 1.62 | 0.202 |
| D-1 | 16.6 | 26.5 | 0.73 | 50.75 | 1.35 | 0.170 |
| D-2 | 16.6 | 25.8 | 0.92 | 50.71 | 0.86 | 0.140 |
| E-1 | 16.5 | 26.3 | 0.73 | 51.01 | 1.02 | 0.266 |
| E-2 | 16.5 | 25.8 | 0.92 | 50.86 | 1.07 | 0.233 |

As the above data demonstrates, the composition used in the novel method ("D" Series) produced highly satisfactory results. These results are surprising when it is realized that the preferred known effective deresinator, Polyfac ® PN-209, was added at only a 0.365 percent level in these cooks. In other words, the average cost effective minimum of 0.73 percent of this component was reduced by 50 percent. Instead, the marginally effective sulfonated fatty acid ("C" Series) was substituted therefor in direct proportions to provide the desirable result (0.170 percent resin). These effects were achieved using a second component which, as shown for cook number C-1, could achieve a reduction to only 0.202 percent resin when added at a significantly higher concentration of 1.81 percent.

The surprising results achievable with the method will provide an economic benefit to an average paper mill which is concerned with resin removal.

That which is claimed is:

1. In a process for the production of wood pulp which includes a deresinating step during which wood chips or wood pulp is contacted with a predetermined effective concentration of an ethoxylated alkyl phenol deresinating composition for removing resin which is normally present therein, the improvement comprising substituting a sulfonated fatty acid in direct proportion for part of the ethoxylated alkyl phenol, wherein the resulting substituted deresinating composition mixture of ethoxylated alkyl phenol and sulfonated fatty acid achieves substantially the same level of deresination as the non-substituted deresination composition.

2. A process for the production of wood pulp according to claim 1 wherein said ethoxylated alkyl phenol is the phosphate ester of an ethoxylated alkyl phenol and wherein said sulfonated fatty acid has at least 18 carbon atoms.

3. A process for the production of wood pulp according to claim 2 wherein said phosphate ester is the phosphate ester of ethoxylated nonyl phenol.

4. A process for the production of wood pulp according to claim 3 wherein said sulfonated fatty acid has been hydrolyzed.

5. A process according to claim 1 wherein said ethoxylated alkyl phenol and said sulfonated fatty acid are present in said mixture in approximately equal proportions by weight.

6. In a process for the production of wood pulp which includes a deresinating step during which wood chips or wood pulp is contacted with a predetermined effective concentration of a 9–10 mole ethoxylated nonyl phenol deresinating composition for removing resin which is normally present therein, the improvement comprising substituting a sulfonated fatty acid derived from tall oil fatty acids in direct proportion for part of the ethoxylated alkyl phenol, wherein the resulting substituted deresinating composition mixture of a phosphate ester of a 9–10 mole ethoxylated nonyl phenol and a sulfonated fatty acid derived from tall oil fatty acids achieves substantially the same level of deresination as the non-substituted deresination composition.

7. In a process for the deresination of wood during the manufacture of wood pulp at elevated temperatures in aqueous alkaline medium comprising the steps of incorporating a predetermined amount of a deresinating composition sufficient to effect deresination in said alkaline medium under prevailing pulping conditions, said deresinating composition comprising an ethoxylated alkyl phenol, contacting the wood with the alkaline medium containing said deresinating composition, and thereafter pulping the wood, the improvement comprising substituting a sulfonated fatty acid in direct proportion for part of the ethoxylated alkyl phenol, wherein the resulting substituted deresinating composition mixture of the ethoxylated alkyl phenol and the sulfonated fatty acid achieves substantially the same level of deresination as the non-substituted deresinating composition.

8. A process for the deresination of wood according to claim 7 wherein said ethoxylated alkyl phenol is the phosphate ester of an ethoxylated alkyl phenol and wherein said sulfonated fatty acid contains at least 18 carbon atoms.

9. A process for the deresination of wood according to claim 8 wherein said phosphate ester is the phosphate ester of ethoxylated nonyl phenol.

10. A process for the deresination of wood according to claim 9 wherein said sulfonated fatty acid is derived from tall oil fatty acids having at least 18 carbon atoms.

11. A process for the deresination of wood according to claim 10 wherein said phosphate ester of an ethoxylated nonyl phenol is the phosphate ester of a 9–10 mole ethoxylated nonyl phenol.

12. A process for the deresination of wood according to claim 11 wherein said sulfonated fatty acid has been hydrolyzed.

13. In a process for the deresination of wood pulp during post-digestion processing in an aqueous alkaline medium which comprises the steps of incorporating in said alkaline medium a predetermined amount of a deresinating composition sufficient to effect deresination in said alkaline medium under prevailing processing conditions, said deresinating composition comprising an ethoxylated alkyl phenol, and contacting the pulp with the alkaline medium containing said composition, the improvement comprising substituting a sulfonated fatty acid in direct proportion for part of the ethoxylated alkyl phenol, wherein the resulting substituted deresinating composition mixture of the ethoxylated alkyl phenol and the sulfonated fatty acid achieves substantially the same level of deresination as the non-substituted deresinating composition.

14. A process for the deresination of wood pulp according to claim 13 wherein said ethoxylated alkyl phenol is the phosphate ester of an ethoxylated alkyl phenol and wherein said sulfonated fatty acid contains at least 18 carbon atoms.

15. A process for the deresination of wood pulp according to claim 14 wherein said phosphate ester is the phosphate ester of ethoxylated nonyl phenol.

16. A process for the deresination of wood pulp according to claim 15 wherein said phosphate ester of ethoxylated nonyl phenol is a 9–10 mole ethoxylated nonyl phenol and wherein said sulfonated fatty acid is derived from tall oil fatty acids.

17. A process for the deresination of wood pulp according to claim 16 wherein said sulfonated tall oil fatty acid has been hydrolyzed.

* * * * *